United States Patent [19]

Osika

[11] Patent Number: 4,667,073

[45] Date of Patent: May 19, 1987

[54] ELECTRICAL SWITCH WITH SELF CONTAINED INDICATING MEANS

[75] Inventor: Thomas F. Osika, Valparaiso, Ind.

[73] Assignee: McGill Manufacturing Company, Inc., Valparaiso, Ind.

[21] Appl. No.: 730,775

[22] Filed: May 3, 1985

[51] Int. Cl.[4] ..... H01H 9/16; H01H 9/18

[52] U.S. Cl. ..... 200/317; 200/315; 200/310; 200/311; 174/66; 174/56

[58] Field of Search ..... 200/317, 315, 308, 309, 200/310, 311, 313; 174/55, 56, 66, 67

[56] References Cited

U.S. PATENT DOCUMENTS

| | | | |
|---|---|---|---|
| 2,434,442 | 1/1948 | Stanfield | 200/317 X |
| 2,515,820 | 7/1950 | Clark | 200/310 X |
| 2,933,581 | 4/1960 | Naimer | 200/308 |
| 3,409,751 | 11/1968 | Krieger | 200/315 |
| 3,598,950 | 8/1971 | Ohashi | 200/315 |
| 4,095,067 | 6/1978 | La Scola | 200/317 X |
| 4,191,873 | 3/1980 | Woodard | 200/315 X |
| 4,242,551 | 12/1980 | Sorenson | 200/302.3 |
| 4,268,734 | 5/1981 | Sorenson | 200/302.3 |
| 4,291,211 | 9/1981 | Discenza | 200/311 |
| 4,377,049 | 3/1983 | Simon et al. | 200/309 |

FOREIGN PATENT DOCUMENTS

| | | | |
|---|---|---|---|
| 202884 | 12/1954 | Australia | 200/311 |
| 520334 | 6/1953 | Belgium | 200/311 |
| 1046143 | 12/1958 | Fed. Rep. of Germany | 200/317 |
| 1112272 | 3/1956 | France | 200/317 |
| 1572169 | 7/1980 | United Kingdom | 200/317 |
| 2124027 | 2/1984 | United Kingdom | 200/317 |

*Primary Examiner*—Stephen Marius
*Assistant Examiner*—Ernest G. Cusick
*Attorney, Agent, or Firm*—Leydig, Voit & Mayer

[57] ABSTRACT

An electrical toggle switch with self-contained indicating devices for displaying the operating condition of the switch and the electrical equipment controlled thereby. The switch may be of the single pole double throw type, or the double pole double throw type, operated by a three position toggle lever which actuates a fulcrum mounted conductive bridge. The switch housing incorporates indicating lamps with color coded lenses. A legend plate assembly mounted on the switch includes a readily interchangeable legend plate which indicates switch function whether or not specifically illuminated.

21 Claims, 12 Drawing Figures

SWITCH POSITION 1

SWITCH POSITION 2

SWITCH POSITION 3

SWITCH POSITION 1
LIGHT A AND C ON

SWITCH POSITION 2
LIGHT C ON

SWITCH POSITION 3
LIGHT B AND C ON

ELECTRICAL SWITCH WITH SELF CONTAINED INDICATING MEANS

BACKGROUND OF THE INVENTION

The present invention relates in general to electrical switches, and more particularly, to toggle actuated switches of the single pole double throw, and double pole double throw, type with self-contained indicating means.

Selectively operable electrical switches have long been utilized for actuating electrical components of industrial equipment, and for simultaneously engaging an indicator light to show when the equipment is in energized condition. Such indicator lights are typically located on a control panel associated with the equipment. When a multiplicity of such switches is required, and particularly when separate indicator lights are located remote from their respective switches, it is frequently difficult to associate the indicator light with the operating position of a particular switch. Even when the indicator light is mounted in closer proximity to the switch, it can be difficult to associate the condition of the switch in relation to the actuation of a light if the switch is utilized for controlling multiple circuit arrangements. While toggle type switches have been available with illuminated bats or toggle levers, the illumination of the bat itself does not necessarily depict a particular operating condition of the device actuated by the switch.

Various means have also been utilized or proposed to provide a legend for indicating the operating condition of the switch. Such arrangements have often suffered drawbacks, such as difficulty in applying them to the switch, not being susceptible of easy notice, and being unchangeable for different operating functions of the switch.

SUMMARY OF THE INVENTION

It is an object of the present invention to provide an electrical switch which permits easier, more reliable and automatic indication of the operating condition of the switch and the electrical device controlled thereby.

Another object of the invention is to provide a switch as characterized above which has self-contained indicating means for depicting a plurality of operating conditions of the switch.

A further object is to provide a switch of the type set forth above which includes self-contained electric indicating lamps for showing various operating conditions of the switch.

Still another object is to provide a switch of the foregoing type which includes an illuminated legend plate for providing easily noticeable indication of the operating condition of the switch.

A further object is to provide a relatively simple legend plate assembly for electrical switches permitting the use of relatively thin gauge, attractive silk screen legend plates which may be selectively installed or changed on the switch to suit a particular need.

Other objects and advantages of the invention will become apparent from the following detailed description and the accompanying drawings.

The foregoing objectives are accomplished by constructing an electrical toggle switch having a box-like housing and a housing cover attached thereto; a toggle lever pivotally engaged by the housing cover having three operative positions; a plurality of terminals fixed to the bottom wall of the housing and connected to corresponding contacts and connecting rivets inside the housing; a conductive bridge having a pair of contacts adjacent its ends; a supporting fulcrum for the bridge; a detent interposed between the toggle lever and the conductive bridge; indicator lamp means in said housing adapted to show the operating condition of the switch for each operative position of the toggle lever; and an interchangeable legend plate fixed to the housing cover and adapted to indicate switch function by illuminated or non-illuminated legend.

Figure 1:
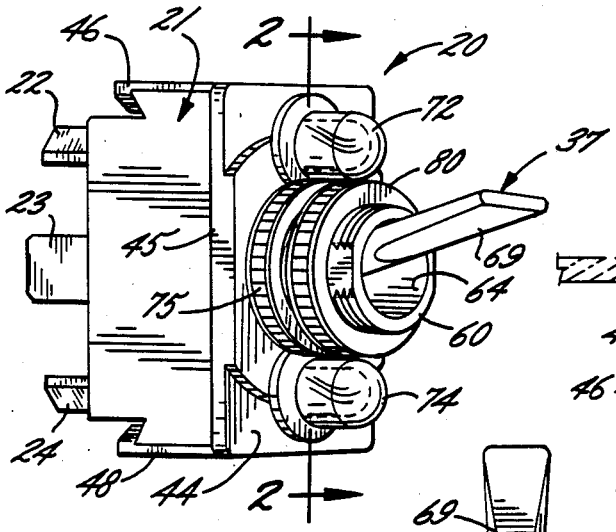
FIG. 1 is a perspective view of an illustrative electrical toggle switch with self-contained indicating means exemplifying the present invention.

While the invention is susceptible of various modifications and alternative constructions, two specific embodiments thereof have been shown by way of example in the drawings and will be described below in considerable detail. It should be understood, however, that there is no intention to limit the invention to the specific forms disclosed but, on the contrary, the intention is to cover all modifications, alternative constructions, and equivalents falling within the scope of the appended claims.

DESCRIPTION OF THE PREFERRED EMBODIMENT

Referring more specifically to the drawings, the invention is there exemplified in an electrical toggle switch 20 which in this instance happens to be of the single pole double throw type. The switch 20 comprises a box-like housing 21 having a plurality of plug-in terminals 22, 23, 24 and 25 projecting outwardly from the bottom wall of the housing. The terminals 22–25 are connected respectively to a series of switch contacts 28, 29, connectors 26, 27, and connecting rivets 30, 31, 32, 33 situated on the upper face of the bottom wall of the housing 21. A conductive bridge 34 having a pair of contacts 35, 36 adjacent the opposite ends thereof is rockably mounted on a bridge support 38 situated midway between the contacts 28, 29 on the bottom wall of the housing. The bridge 34 has a laterally enlarged central portion 39 which, together with adjacent portions of the bridge arms 40, 41, interfits with four equally spaced upstanding lugs 42 integral with the bridge support. This arrangement permits the bridge 34 to be rocked by toggle lever or bat 37 so as to engage selectively its contact 35 with the contact 28, or its contact 36 with the contact 29, on the bottom wall of the housing.

A housing cover 44 having the general shape of an inverted "U" is provided as a top closure for the housing. The cover 44 comprises a generally rectangular central panel 45 having a pair of side panels 46, 48 depending from the ends thereof. The panels 46, 48, while integrally connected with the central panel 45, are sufficiently resilient to permit their being spread apart to permit assembly of the housing cover upon the housing.

In order to facilitate assembly of the housing cover on the housing, the ends of the latter are fashioned with relatively shallow grooves 49, 50 of appropriate width to create a snug sliding fit with the respective cover side panels 46, 48. To retain the cover 44 on the housing 21, the latter is fashioned with undercut grooves 51, 52 in the lower portion of its end walls. The side panels 46, 48 of the cover are correspondingly provided with a pair of locking shoulders 54, 55 at their lower ends. For ease of assembly, the inside lower end portions of the shoulders 54, 55 are formed with chamfers 56, 57. By reason of the foregoing construction, it will be appreciated that the housing cover 44 may readily be slid onto the housing and pressed downwardly until the shoulders 54, 55 interlock with the undercut grooves 51, 52 in the ends of the housing 21.

The housing and cover are formed with additional retaining means to secure the cover 44 in place on the housing 21 (Figs. 1A–4). The top face of the housing is accordingly formed with a pair of raised shoulders 58 extending along the outer edges of the two longer walls. The inside face of the cover center panel 45 is formed with a pair of relatively flat lands 59 adapted to fit between the shoulders 58 and lock the cover against lateral motion relative to the housing.

Figure 2:
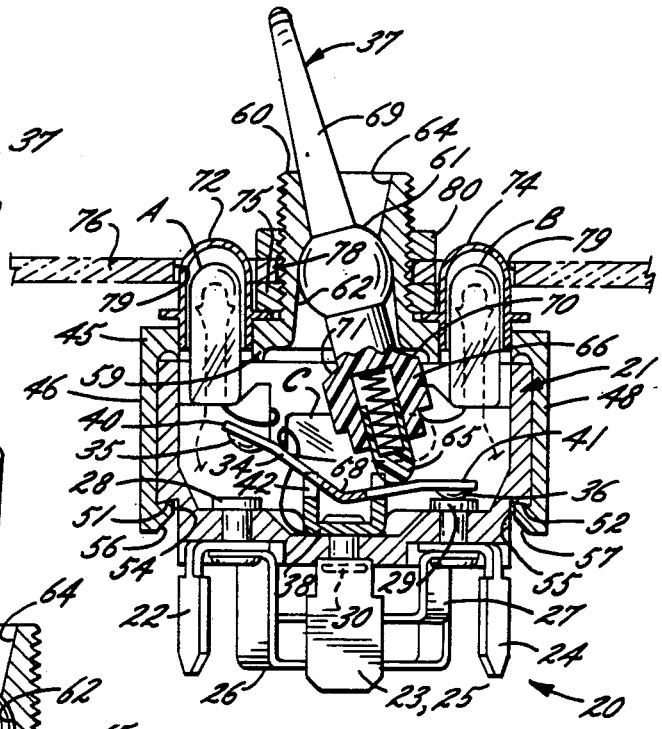
FIG. 2 is an enlarged vertical sectional view through the illustrative switch taken in the plane of the line 2—2 in FIG. 1 with the toggle lever in its first position.
Figure 1A:
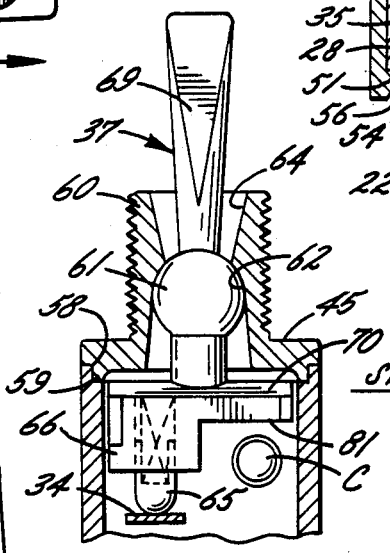
Fig. 1A is an elevational view of the toggle lever or bat of the electrical toggle switch shown in FIG. 1 and its relation to the switch housing.
Figure 3:
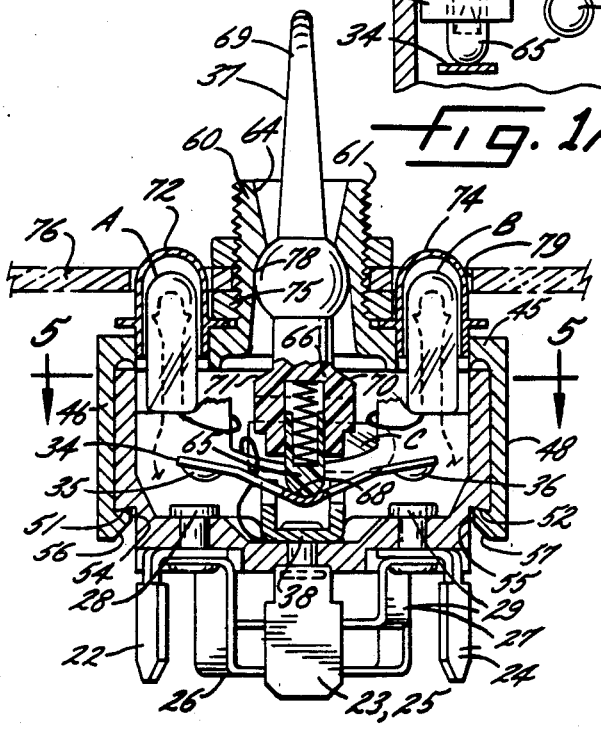
FIG. 3 is a vertical sectional view of the switch similar to FIG. 2 but showing the toggle lever in its second position.
Figure 4:
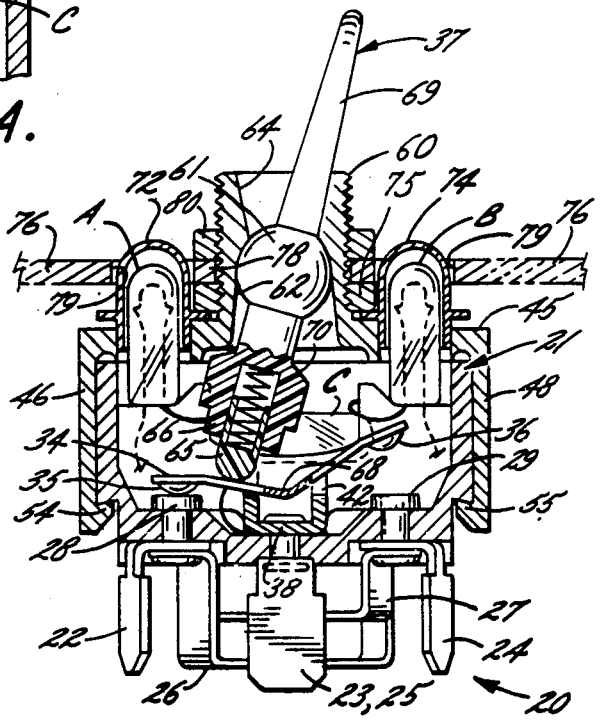
FIG. 4 is a vertical sectional view similar to FIGS. 2 and 3 but showing the toggle lever in its third position.
Figure 5:
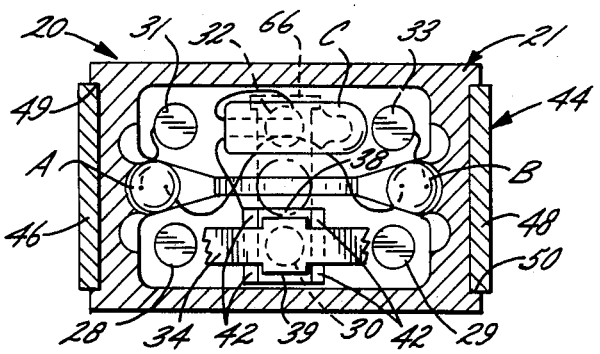
FIG. 5 is a horizontal sectional view through the illustrative switch taken in the plane of the line 5—5 in FIG. 3.

To accommodate the toggle lever or bat 37, the central panel 45 of the cover has a large, externally threaded annular hub 60 projecting upwardly from the central area thereof. The hub 60 supports the toggle lever 37 which is adapted to swivel therein between three distinct operating positions (FIGS. 2–4). The toggle lever 37 is formed with an integral spherical ball 61 which mates with a corresponding spherical recess 62 in the hub. In order to provide sufficient clearance for the swiveling motion of the toggle lever, the spherical section of the hub merges into an outwardly flaring bore 64. The toggle lever is maintained in engagement with the spherical bore in the hub 60 by means of a small diameter spring loaded detent 65 which is adapted to traverse along the upper surface of the conductive bridge 34. The detent 65 is slidably housed in a blind bore formed in guide block 66 on the lower end of the toggle lever 37. The detent exerts sufficient upward thrust on the toggle lever to hold the latter in the spherical recess 62.

Provision is made in the switch 20 for precisely defining each of the three operative positions of the toggle lever 37. To define the number one and number three positions of the lever 37, reliance is placed upon abutment of the lever 37 with the outwardly flaring bore 64 of the annular hub 60 (FIGS. 2 and 4). In order to confine the swivel motion of the toggle lever 37 to the longitudinal axial plane of the switch housing 21, use is made of the guide block 66. The block 66 is of generally rectangular cross section in a plane perpendicular to the axis of the toggle lever. Its upper surface, that is the surface which faces toward the spherical ball, is formed with two chamfers 70, 71 defining an obtuse angle with respect to each other. These chamfers provide clearance between the block 66 and the underlying surface of the central cover panel 45. The ends of the block 66 have a small running clearance with the opposed inner surfaces of the housing side walls and maintain the motion of the toggle lever substantially in the longitudinal axial plane of the switch housing 21.

In order to define the middle or number two position of the toggle lever 37, resort is had to the detent 65 and the conductive bridge 34. Accordingly, the laterally enlarged central portion 39 of the bridge is formed with a transverse groove 68 on its upper face. The arms of the bridge 34 are fashioned in a dihedral angle, being bent slightly toward one another for switching purposes. This construction thus defines a relationship which permits the detent to be shifted from either the number one or number three switch position to a middle or number two position where the detent tends to remain centered in the transverse groove of the conductive bridge 34. This defines the number two position of the toggle lever.

In accordance with one aspect of the invention, provision is made for incorporating indicator lamp means within the switch housing 21 to show the operating condition of the switch 20 (FIGS. 1 and 2–8). This is accomplished in the present instance by incorporating two self contained indicator lamps A, B into the switch housing 21. Each lamp may, for example, be a miniature type rated at 14 volts and 0.08 amperes with an average life of 50,000 hours. Each lamp is connected to the power source in series with a pair of contacts 28, 35 or 29, 36 so as to light selectively depending upon the position of the toggle lever 37. Thus when the lever 37 is in its number one position as shown in FIG. 2, the lamp A is energized. When the lever 37 is in position number 3, shown in FIG. 4, the lamp B is energized. When the lever 37 is in its number 2 position, neither lamp is energized.

To protect the lamps A, B and also maintain their position within the switch 20, the lamps are provided with lenses 72, 74. The lenses are press fitted into apertures on either side of the threaded hub 60. Each lens has a transverse flange which seats upon a slightly raised annular boss on the housing cover and is retained in place by means of a nut 75 on the hub 60. The lenses are color coded and each one may readily be interchanged with one of a different color depending upon the user's needs.

The switch 20 as described above may readily be installed upon a mounting panel 76 or similar support such as a cabinet wall. A central aperture 78 slightly larger in diameter than the threaded hub 60 and a pair of smaller diameter apertures 79 slightly larger than the lamp lenses are then made in the control panel. The switch is then inserted into position against the rear face of the panel and the hub 60 and lenses for the lamps A, B are inserted in their respective apertures until the nut 75 abuts solidly against the rear face of the panel. A nut 80, similar to the nut 75, is then screwed onto the hub 60 and tightened against the outer face of the panel, positively securing the switch to the panel. The receptacle fitting (not shown) may then be connected to the plug-in terminals 22–26 and the switch may be placed in operation.

In the form shown in FIGS. 1–4, indicator lamp A lights when the toggle lever 37 is inclined to the left, closing the contacts 29, 36. When the toggle lever is inclined to the right, as shown in FIG. 4, switch position number three, contacts 28 and 35 close, thereby lighting lamp B. When the toggle lever 37 is in a vertical position as shown in FIG. 3, switch position 2, the contacts 28, 35 and 29, 36 are both opened and neither lamp is lighted.

The switch 20 may also be equipped with an additional lamp C for the purpose of continuously illuminating the toggle lever 37 and bat 69 to indicate that power is present in the switch. For this purpose, lamp C, which is identical in size and capacity to lamps A and B, is disposed generally horizontally on the opposite side of the housing from the bridge and overlying the connecting rivets 31, 32 and 33. The guide block 66 of the toggle lever has a relatively large relief notch 81 cut out of the portion overlying the lamp C. It will be appreciated that, when the lamp C is lighted, the plastic material of the toggle lever 37, which may be tinted with red or another color, will readily conduct the light upwardly through itself and be continuously illuminated. The orientation of the lamp C within the switch is indicated in FIGS. 2–4 and shown in more detail in FIG. 5.

Figure 6:
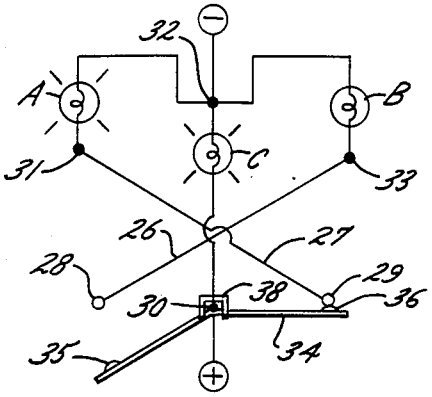
FIGS. 6, 7 and 8 are diagrammatic views illustrating the indicating lamp connections for switch positions 1, 2 and 3, respectively.
Figure 7:
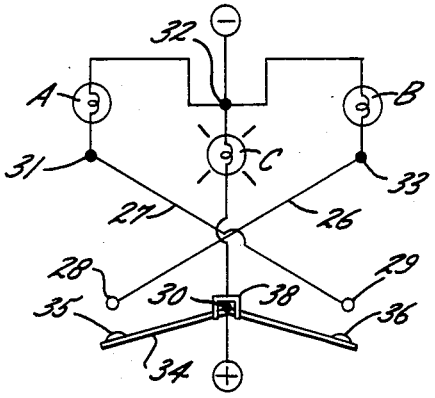
Figure 8:
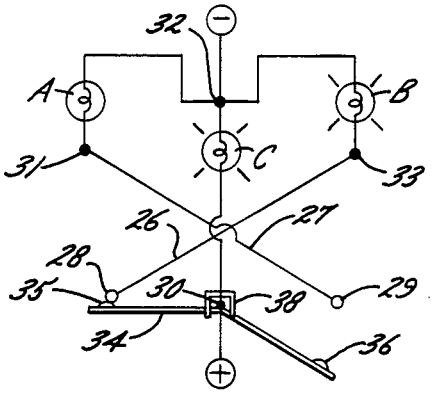
Figure 9:
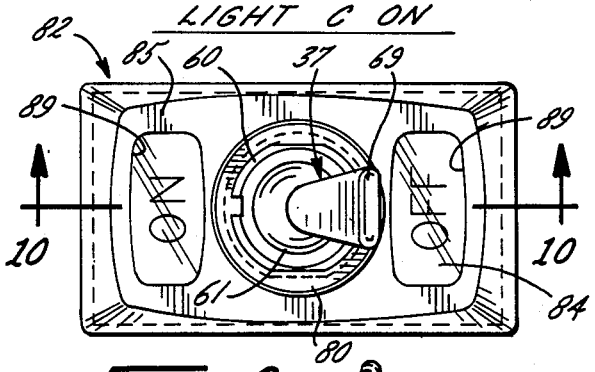
FIG. 9 is a plan view of the illustrative switch showing the legend plate assembly in place and the legend containing portions of the interchangeable legend plate.

FIGS. 6–8 illustrate diagrammatically the operation of the switch for different positions of the toggle lever 37 and the conductive bridge 34. As shown, the lamps A and B light only when a corresponding pair of contacts for one of those lamps is closed. The lamp C remains energized and illuminates the toggle lever.

In accordance with another aspect of the present invention, the switch 20 may include an interchangeable legend plate assembly 82 which can be readily adapted or changed to indicate a variety of switch functions for given positions of the toggle lever. The assembly 82 permits the user to selectively determine the legend to be used with the switch and is susceptible of easy installation and changing.

Figure 10:
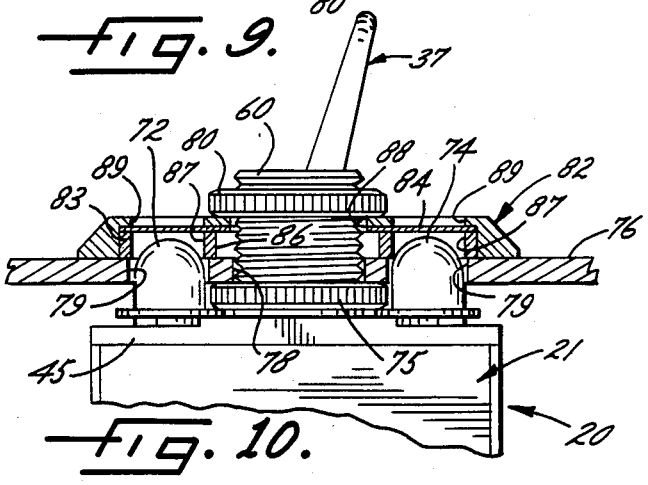
FIG. 10 is a fragmentary vertical sectional view taken through the illustrative switch in the plane of the line 10—10 in FIG. 9 with the legend plate assembly attached.
Figure 11:
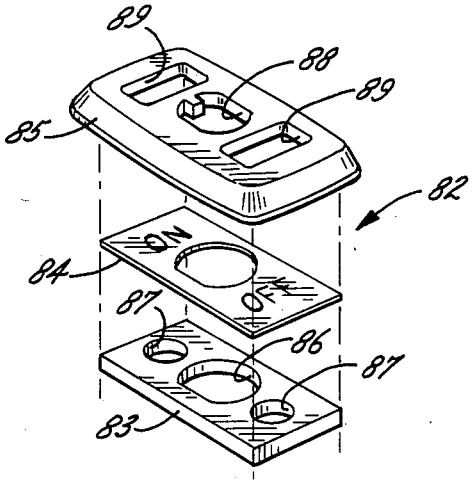
FIG. 11 is an exploded perspective view on a somewhat reduced scale illustrating the legend plate assembly consisting of the interchangeable legend plate along with the underlying support and the top cover plate.

The legend plate assembly 82 comprises three component parts. These are a support plate 83, a backplate or legend plate 84, and a cover plate 85. Referring more specifically to FIG. 11, it will be noted that the support plate 83 has a central aperture 86 adapted to fit over the threaded hub 60 and a pair of apertures 87 adapted to fit over the outwardly projecting lenses 72, 74 of the indicator lamps, as shown in FIG. 10. The legend plate 84 is a silkscreen plate of about 0.010 inch thickness with a central aperture which fits over the threaded hub 60 and carries appropriate legend for the operating conditions of the switch. The support plate 83 and legend plate 84 are adapted to nest within the cover plate 85. The latter is formed with a central aperture 88 to fit over the threaded hub and a pair of oblong apertures 89 to expose the indicia on the legend plate 84. The legend plate assembly 82 is mounted as a unit on the threaded hub 60 after the switch has been installed on the mounting panel 76 (FIG. 10). The retainer nut 80 secures the switch in position on the mounting panel with the legend plate assembly abutting the front face of the panel.

It will be appreciated from the foregoing that the legend plate assembly 82 may quickly and easily be detached from the switch, the legend plate 84 changed or modified in accordance with new or different functions assigned to the switch, and the assembly 82 reinstalled on the switch. The legend plate 84 lends itself particularly well to use with the illuminated switch. It may, however, be used also without illumination.

I claim as my invention:

1. An electrical toggle switch with self-contained indicating means for displaying its operating condition comprising, in combination:
   (a) a box-like housing of non-conducting material having bottom, side walls, and a housing cover;
   (b) a plurality of terminals fixed to the bottom wall of said housing;
   (c) a plurality of contacts defined on the upper face of said bottom wall connected with respective ones of said terminals;
   (d) a conductive bridge having a pair of contacts adjacent opposite ends thereof;
   (e) a toggle lever pivotally supported within said housing cover and having a plurality of operative positions;
   (f) a bridge support connected to one said terminal and adapted to serve as a fulcrum supporting said bridge for pivotal movement thereon between a plurality of operative positions corresponding to the respective operative positions of said toggle lever;
   (g) a plurality of indicator lamps in said housing cover in close proximity to the toggle lever and each being adapted to be energized to show the operating condition of said switch in response to positioning of said toggle lever to a respective one of its operative positions, said indicator lamps each having a portion protruding outwardly of said housing cover for ease of detection upon energization thereof;
   (h) a plurality of lenses mounted within said housing cover for receiving a respective one of said indicator lamps, each said lens having a portion protruding outwardly of said housing cover for ease of deletion upon energization of the indicator lamp received therein;
   (i) a further separate indicator lamp disposed within said housing below said housing cover and adapted to be energized to illuminate said toggle lever.

2. The combination set forth in claim 1 wherein said lines are color coded.

3. The combinations set forth in claim 1, wherein said housing cover has an annular extension with an outwardly flaring bore; said extension defining a swivel socket for said toggle lever; said outwardly flaring bore defining stops for the arcuate motion of said toggle lever.

4. The combination set forth in claim 3, wherein said toggle lever is formed with a guide block adjacent its inner end; said guide block being disposed on said toggle lever for movement with a predetermined clearance relative to the opposed side walls of said housing to maintain the arcuate motion of said toggle lever substantially in the central longitudinal plane of said housing.

5. The combination set forth in claim 4, wherein said guide block of said toggle lever has a blind bore in alignment with said conductive bridge; and a spring load biasing member is slidably housed in said blind bore in resilient engagement with said conductive bridge.

6. The combination set forth in claim 1 wherein said further indicator lamp is adapted to be energized to illuminate said toggle lever in all positions of said toggle lever.

7. The combination set forth in claim 6, wherein said guide block is formed with a relief notch to avoid engagement with said third indicator lamp upon pivoting of said toggle lever.

8. The combination set forth in claim 7, wherein said third indicator lamp is aligned with the relief notch of said guide block so as to illuminate said bat in all positions of said toggle lever.

9. The combination recited in claim 1, wherein said toggle lever is formed with a guide block at its lower end, a ball swivel in spaced relation above said guide block, and a bat connected to the top of said ball swivel; said indicator lamps including a pair of indicator lamps situated in the longitudinal axial plane of said housing adjacent either end of said housing and outside the arcuate path of said guide block.

10. An electrical toggle switch with self-contained indicating means for displaying its operating condition comprising in combination;

(a) a box-like housing;

(b) a toggle lever pivotably supported within the housing and having a plurality of operative positions;

(c) electrical circuitry selectively actuatable by positioning of said toggle lever in selective of said operative positions;

(d) a plurality of indicator lamps in said housing in close proximity to said toggle lever, said indicator lamps each being adapted to be energized to show the operating condition of said switch in response to positioning of said toggle lever to a respective one of its operative positions, each said indicator lamp having a portion protruding outwardly of said housing for enhancing detection thereof upon energization;

(e) a legend cover plate having a central aperture adapted to fit over said toggle lever and a plurality of apertures each adapted for positioning in alignment with one of said indicator lamps;

(f) a legend support plate positionable on said housing in underlying relation to said cover plate, said legend support plate being formed with a central aperture adapted to fit over said toggle lever and a plurality of apertures each adapted to fit over one of said indicator lamps; and (g) an interchangable legend plate formed with a central aperture adapted to fit over said toggle lever in interposed relationship between said support plate and cover plate in a plane over the protruding portions of said indicator lamps for indicating the switch function in relation to the position of said switch.

11. The combination set forth in claim 10 in which said cover plate has a generally rectangular recess on its underside, and said support plate underlies said cover plate in telescopically housed relation within said recess.

12. The combination set forth in claim 11 in which said housing has an extension defining a swivel socket for said toggle lever; and the central apertures in said cover plate, support plate and legend plate each are adapted to fit over said extension.

13. An electrical toggle switch with self-contained indicating means for displaying its operating condition comprising, in combination:

(a) a box-like housing of non-conductive material having bottom, side walls, and a housing cover;

(b) a plurality of terminals fixed to the bottom wall of said housing;

(c) a plurality of contacts defined on the upper face of said bottom wall connected with respective ones of said terminals;

(d) a conductive bridge having a pair of contacts adjacent opposite ends thereof;

(e) a toggle lever pivotally supported within said housing cover and having a plurality of operative positions, said toggle lever being formed with a guide block at its lower end, a ball swivel in spaced relation above said guide block, and a bat connected to the top of said ball swivel;

(f) a bridge support connected to one said terminal and adapted to serve as a fulcrum supporting said bridge for pivotal movement thereon between a plurality of operative positions corresponding to the respective operative positions of said toggle lever; and (g) indicator lamp means in said housing adapted to show the operating condition of said switch for each said operative position of said toggle lever, said indicator lamp means comprising a pair of indicator lamps situated in the longitudinal axial plane of said housing adjacent either end of said housing and outside the arcuate path of said guide block, each indicator lamp of said pair having a portion extending outwardly of said housing for easy detection upon energization thereof, (h) a plurality of lenses mounted within said housing cover for receiving a respective one of said indicator lamps, each said lens having a portion protruding outwardly of said housing cover for ease of detection upon energization of the indicator lamp received therein; and (i) a third indicator lamp disposed along side said conductive bridge adjacent the bottom of said housing to permit passage of said guide block upon pivoting of said toggle lever.

14. The combination set forth in claim 13 wherein said further indicator lamp is adapted to be energized to illuminate said toggle lever in all positions of said toggle lever.

15. An electrical toggle switch with self-contained indicating means for displaying its operating condition comprising in combination:

(a) a box-like housing having a housing cover;

(b) a toggle lever pivotably supported within the housing cover and having a plurality of operative positions;

(c) electrical circuitry selectively actuatable by positioning of said toggle lever in selective of said operative positions;

(d) a pair of indicator lamps located on the longitudinal axial plane of said housing cover adjacent opposite sides of said toggle lever in close proximity thereto, said indicator lamps each being adapted to be energized to show the operating condition of said switch in a respective one of the operative positions of said toggle lever, and said indicator lamps each having a portion protruding outwardly of said housing cover; and (e) a plurality of lenses mounted within said housing cover for receiving a respective one of said indicator lamps, each said lens having a portion protruding outwardly of said housing cover for ease of detection upon energization of the indicator lamp received therein.

16. The combination set forth in claim 15 including a further indicator lamp disposed within said housing and adapted to be energized to illuminate said toggle lever in all positions of said toggle lever.

17. An electrical toggle switch with self-contained indicating means for displaying its operating condition comprising in combination:

(a) a box-like housing;

(b) a toggle lever pivotably supported within the housing and having a plurality of operative positions;

(c) electrical circuitry selectively actuatable by positioning of said toggle lever in selective of said operative positions;

(d) a plurality of indicator lamps in said housing each being adapted to be energized to show the operating condition of said switch in response to positioning of said toggle lever to a respective one of its operative positions, each said indicator lamp having a portion protruding outwardly of said housing;

(e) a plurality of color coded lenses mounted within said housing each receiving a respective one of said indicator lamps, said lens each having a portion protruding outwardly of said housing for easy detection upon energization of the lamp received therein, (f) a legend cover plate having a central aperture adapted to fit over said toggle lever and a plurality of apertures each adapted for positioning in alignment with one of said indicator lamps;

(g) a legend support plate positionable on said housing in underlying relation to said cover plate, said legend support plate being formed with a central aperture adapted to fit over said toggle lever and a plurality of apertures each adapted to fit over one of said indicator lamps; and (h) an interchangable legend plate formed with a central aperture adapted to fit over said toggle lever in interposed relationship between said support plate and cover plate in a plane over the protruding portions of said indicator lamps for indicating the switch function in relation to the position of said switch.

18. The combination set forth in claim 17 wherein said cover plate and support plate each has apertures registering with the respective lenses of said indicator lamps.

19. An electrical toggle switch with self-contained indicating means for displaying its operating condition comprising, in combination:

(a) a box-like housing of non-conductive material having bottom, side walls, and a housing cover;

(b) a plurality of terminals fixed to the bottom wall of said housing;

(c) a plurality of contacts defined on the upper face of said bottom wall connected with respective ones of said terminals;

(d) a conductive bridge having a pair of contacts adjacent opposite ends thereof;

(e) a bridge support connected to one said terminal and adapted to serve as a fulcrum supporting said bridge for pivotal movement thereon between a plurality of operative positions corresponding to the respective operative positions of said toggle lever;

(f) a plurality of indicator lamps in said housing in close proximity to the toggle lever and each being adapted to be energized to show the operating condition of said switch in response to positioning of said toggle lever to a respective one of its operative positions;

(g) said housing cover having lenses mounted therein each for receiving a respective one of the indicator lamps;

(h) a further lamp disposed within said housing and adapted to be energized to illuminate said toggle lever;

(i) said housing cover having an extension defining a swivel socket for said toggle lever;

(j) a cover plate fixed to said extension having a generally rectangular recess on its underside and apertures registering with the respective lenses of said indicator lamps; and (k) a support plate underlying said cover plate and telescopically housed within said recess, said support plate having apertures registering with said indicator lamps.

20. A electrical toggle switch with self-contained indicating means for displaying its operating condition comprising, in combination:

(a) a box-like housing of non-conductive material having bottom, side walls, and a housing cover;

(b) a plurality of terminals fixed to the bottom wall of said housing;

(c) a plurality of contacts defined on the upper face of said bottom wall connected with respective ones of said terminals;

(d) a conductive bridge having a pair of contacts adjacent opposite ends thereof;

(e) a bridge support connected to one said terminal and adapted to serve as a fulcrum supporting said bridge for pivotal movement thereon between a plurality of operative positions corresponding to the respective operative positions of said toggle lever;

(f) a plurality of indicator lamps in said housing in close proximity to the toggle lever and each being adapted to be energized to show the operating condition of said switch in response to positioning of said toggle lever to a respective one of its operative positions;

(g) a further indicator lamp disposed within said housing and adapted to be energized to illuminate said toggle lever;

(h) said housing cover having an extension defining a swivel socket for said toggle lever;

(i) a cover plate having a central aperture adapted to fit over said extension and a pair of oblong apertures on either side of said extension, said cover plate also having a generally rectangular recess on its underside;

(j) a support plate underlying said cover plate and telescopically housed within said recess; and (k) an interchangeable legend plate interposed between said support plate and said cover plate to indicate switch function by illuminated or non-illuminated legend.

21. An electrical toggle switch with self-contained indicating means for displaying its operating condition comprising in combination:

(a) a box-like housing;

(b) a toggle lever pivotably supported within the housing and having a plurality of operative positions;

(c) electrical circuitry selectively actuatable by positioning of said toggle lever in selective of said operative positions;

(d) a plurality of indicator lamps in said housing disposed in close proximity to said toggle lever and each being adapted to be energized to show the operating condition of said switch in a respective one of the operative positions of said toggle lever;

(e) a plurality of lenses mounted within said housing for receiving a respective one of said indicator lamps, each said lens having portion protruding outwardly of said housing for easy detection upon energization of the indicator lamp received therein;

(f) a legend cover plate having a central aperture adapted to fit over said toggle lever and a plurality of apertures each adapted for positioning in alignment with one of said indicator lamps;

(g) a legend support plate positionable on said housing in underlying relation to said cover plate, said legend support plate being formed with a central aperture adapted to fit over said toggle lever and a plurality of apertures each adapted to fit over one of said indicator lamps; and (h) an interchangable legend plate formed with a central aperture adapted to fit over said toggle lever in interposed relationship between said support plate and cover plate in a plane over the protruding portions of said indicator lamp lens for indicating the switch function in relation to the position of said switch.

* * * * *